US006219939B1

(12) United States Patent
Kita et al.

(10) Patent No.: US 6,219,939 B1
(45) **Date of Patent: *Apr. 24, 2001**

(54) ATHLETIC SHOE MIDSOLE DESIGN AND CONSTRUCTION

(75) Inventors: Kenjiro Kita; Yasunori Kaneko; Takaya Kimura, all of Osaka (JP)

(73) Assignee: Mizuno Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/910,794

(22) Filed: Aug. 13, 1997

(30) Foreign Application Priority Data

Apr. 18, 1997 (JP) ..... 9-116376

(51) Int. Cl.[7] ..... A43B 13/18; A43B 13/12; A43B 13/14; A43B 7/16

(52) U.S. Cl. ..... 36/28; 36/30 R; 36/25 R; 36/31; 36/92; 36/44

(58) Field of Search ..... 36/27, 28, 30 R, 36/35 R, 25 R, 31, 92, 87, 102, 30 A, 36 A, 37, 71, 44

(56) References Cited

U.S. PATENT DOCUMENTS 1,841,461 * 1/1932 Thoma ..... 36/30 R
2,364,134 * 12/1944 Dow et al. ..... 36/25 R
2,400,487 * 5/1946 Clark ..... 36/25 R
2,677,906 * 5/1954 Reed ..... 36/28
4,399,620 * 8/1983 Funck ..... 36/30 R
4,561,195 * 12/1985 Onoda et al. ..... 36/30 R
4,798,010 * 1/1989 Sugiyama ..... 36/30 R
4,805,319 * 2/1989 Tonkel ..... 36/28
4,864,737 * 9/1989 Marello ..... 36/29

FOREIGN PATENT DOCUMENTS

2032760 * 5/1980 (GB) ..... 36/30 R
90/06699 * 6/1990 (WO) ..... 36/28

OTHER PUBLICATIONS

Suggested Applications For Geon Resins, Modern Plastics Encyclopedia, pp. 449, 450, and 1083, 1948.*

* cited by examiner

*Primary Examiner*—Paul T. Sewell
*Assistant Examiner*—Anthony Stashick
(74) *Attorney, Agent, or Firm*—Sidley & Austin

(57) ABSTRACT

A midsole assembly for an athletic shoe comprising a midsole and a corrugated sheet. The midsole is formed of soft elastic material. The corrugated sheet is disposed in at least a heel portion of the midsole. Either or both amplitude and wavelength of wave configuration of said corrugated sheet are made different either or both between a front end portion and back end portion, and between an medial portion and lateral portion of said heel portion.

9 Claims, 18 Drawing Sheets

ATHLETIC SHOE MIDSOLE DESIGN AND CONSTRUCTION

BACKGROUND OF THE INVENTION

The present invention relates to an athletic shoe midsole design and construction. More particularly, the invention relates to a midsole assembly where there are provided a midsole formed of soft elastic material and a corrugated sheet disposed in the midsole.

The sole of an athletic shoe used in various sports is generally comprised of a midsole and an outsole fitted under the midsole, directly contacting the ground. The midsole is typically formed of soft elastic material in order to ensure adequate cushioning.

Running stability as well as adequate cushioning is required in athletic shoes. There is need to prevent shoes from being deformed excessively in the lateral or transverse direction when contacting the ground.

As shown in Japanese Utility Model Examined Publication No. 61-6804, the applicant of the present invention proposes a midsole assembly having a corrugated sheet therein, which can prevent such an excessive lateral deformation of shoes.

The midsole assembly shown in the above publication incorporates a corrugated sheet in a heel portion of a midsole and it can produce resistant force preventing the heel portion of a midsole from being deformed laterally or transversely when a shoe contacts the ground. Thus, the transverse deformation of the heel portion of a shoe is prevented.

However, it depends on the kind of athletics or athletes whether an athlete lands on the ground more frequently from the medial portion or the lateral portion of the heel at the onset of landing. For example, since tennis or basketball players move more often in the transverse direction and the medial portions of their heels tend to first contact the ground, the heels lean outwardly and so-called supination often occurs. On the other hand, since runners or joggers tend to land on the ground from the lateral portions of their heels and the load moves toward the toes, the heels lean inwardly and so-called pronation often occurs.

These pronation and supination are normal movements when an athlete's foot comes in contact with the ground. But over-pronation or over-supination may cause damages to the ankle, knee and hip of an athlete.

In the conventional midsole design there is provided a corrugated sheet having a constant wave configuration in both the transverse direction and the longitudinal direction of the heel portion. Therefore, the prior art midsole has a constant compressive hardness throughout the midsole and as a result, it cannot control effectively pronation and supination of the foot of an athlete although controlling them is required according to the kind of athletics.

Generally, by inserting a corrugated sheet the heel portion of a midsole tends to be less deformed in the transverse direction. When the corrugated sheet is formed from high elastic material the heel portion of a midsole tends to be less deformed in the vertical direction as well. Therefore, when a corrugated sheet has a constant wave configuration the heel portion of a midsole where adequate cushioning is required may show less cushioning properties in contacting the ground.

On the other hand, good cushioning is indispensable requirements of athletic shoes but too high cushioning may absorb an athletic power such as propellant or jumping power of an athlete.

The object of the present invention is to provide a midsole assembly for an athletic shoe which can prevent the over-pronation and over-supination in landing by preventing the shoe from being deformed in the transverse direction according to the kind of athletics and can not only ensure adequate cushioning but also prevent an athletic power from being lessened.

SUMMARY OF THE INVENTION

The present invention provides a midsole assembly for an athletic shoe and its manufacturing process.

In one embodiment, a midsole assembly comprises a midsole and a corrugated sheet disposed in at least a heel portion of the midsole. The midsole is formed of soft elastic material. Either or both amplitude and wavelength of wave configuration of the corrugated sheet is made different either or both between a front end portion and back end portion, and between a medial portion and lateral portion of the heel portion.

A second embodiment provides a midsole assembly according to the first embodiment, wherein hardness of the corrugated sheet is higher than that of the midsole.

A third embodiment provides a midsole assembly according to the first embodiment, wherein the corrugated sheet is comprised of fiber-reinforced plastic.

A fourth embodiment provides a midsole assembly according to the third embodiment, wherein the fibers of the fiber-reinforced plastic are aligned in one direction.

A fifth embodiment provides a midsole assembly according to the fourth embodiment, wherein the fibers of the fiber-reinforced plastic are oriented to the direction coinciding with the direction of ridges of the wave configuration.

A sixth embodiment provides a midsole assembly according to the fourth embodiment, wherein the fibers of the fiber-reinforced plastic are oriented within ±30° relative to the direction of ridges of the wave configuration.

A seventh embodiment provides a midsole assembly according to the third embodiment, wherein the fibers of the fiber-reinforced plastic are woven by filling and warp, the modulus of elasticity of the filling being greater than or equal to that of the warp.

An eighth embodiment provides a midsole assembly according to the seventh embodiment, wherein the filling being oriented to the direction coinciding with the direction of ridges of the wave configuration.

A ninth embodiment provides a midsole assembly according to the seventh embodiment, wherein the filling being oriented within ±30° relative to the direction of ridges of the wave configuration.

A tenth embodiment provides a midsole assembly according to the first embodiment, wherein a plurality of ribs are provided on the surface of the corrugated sheet, the ribs being oriented to the direction coinciding with the direction of ridges of the wave configuration.

An eleventh embodiment provides a midsole assembly according to the first embodiment, wherein the corrugated sheet is comprised of a first corrugated sheet and a second corrugated sheet, the first corrugated sheet being formed of thermoplastic or thermosetting resin, the circumferential end surface thereof being located inside the side surface of the heel portion of a shoe, the second corrugated sheet being formed of soft elastic material having smaller modulus of elasticity than that of the first corrugated sheet, the circumferential end surface thereof being located at substantially the same position as the side surface of the heel portion of a shoe.

In a twelfth embodiment, a midsole assembly comprises a midsole and a corrugated sheet disposed in at least a heel portion of the midsole. The midsole is formed of soft elastic material and has an aperture in the heel central portion. Either or both amplitude and wavelength of wave configuration of the corrugated sheet is made different either or both between a front end portion and back end portion, and between a medial portion and lateral portion of the heel portion.

A thirteenth embodiment provides a midsole assembly according to the twelfth embodiment, wherein hardness of the corrugated sheet is higher than that of the midsole.

A fourteenth embodiment provides a midsole assembly according to the twelfth embodiment, wherein the corrugated sheet is comprised of fiber-reinforced plastic.

A fifteenth embodiment provides a midsole assembly according to the fourteenth embodiment, wherein the fibers of the fiber-reinforced plastic are aligned in one direction.

A sixteenth embodiment provides a midsole assembly according to the fifteenth embodiment, wherein the fibers of the fiber-reinforced plastic are oriented to the direction coinciding with the direction of ridges of the wave configuration.

A seventeenth embodiment provides a midsole assembly according to the fifteenth embodiment, wherein the fibers of the fiber-reinforced plastic are oriented within ±30° relative to the direction of ridges of the wave configuration.

An eighteenth embodiment provides a midsole assembly according to the fourteenth embodiment, wherein the fibers of the fiber-reinforced plastic are woven by filling and warp, the modulus of elasticity of the filling being greater than or equal to that of the warp.

A nineteenth embodiment provides a midsole assembly according to the eighteenth embodiment, wherein the filling being oriented to the direction coinciding with the direction of ridges of the wave configuration.

A twentieth embodiment provides a midsole assembly according to the eighteenth embodiment, wherein the filling being oriented within ±30° relative to the direction of ridges of the wave configuration.

A twenty-first embodiment provides a midsole assembly according to the twelfth embodiment, wherein a plurality of ribs are provided on the surface of the corrugated sheet, the ribs being oriented to the direction coinciding with the direction of ridges of the wave configuration.

A twenty-second embodiment provides a midsole assembly according to the twelfth embodiment, wherein the corrugated sheet is comprised of a first corrugated sheet and a second corrugated sheet, the first corrugated sheet being formed of thermoplastic or thermosetting resin, the circumferential end surface thereof being located inside the side surface of the heel portion of a shoe, the second corrugated sheet being formed of soft elastic material having smaller modulus of elasticity than that of the first corrugated sheet, the circumferential end surface thereof being located at substantially the same position as the side surface of the heel portion of a shoe.

In a twenty-third embodiment, there is provided a process for forming a midsole assembly for an athletic shoe wherein a corrugated sheet is disposed in at least a heel portion of a midsole. In this embodiment, the process comprises the steps of overlaying a first flat sheet on a second flat sheet, where the first flat sheet is formed of thermoplastic or thermosetting resin and the circumferential end surface thereof is located inside the side surface of the heel portion of a shoe, and the second flat sheet is formed of soft elastic material having smaller modulus of elasticity than that of the first flat sheet and the circumferential end surface thereof is located at substantially the same position as the side surface of the heel portion; and forming the first and second flat sheets into corrugated sheets by placing the first and second flat sheets in a mold and thermoforming them.

For a better understanding of these and other embodiments of the invention, reference should be made to the following detailed description taken in conjunction with the accompanying drawings.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
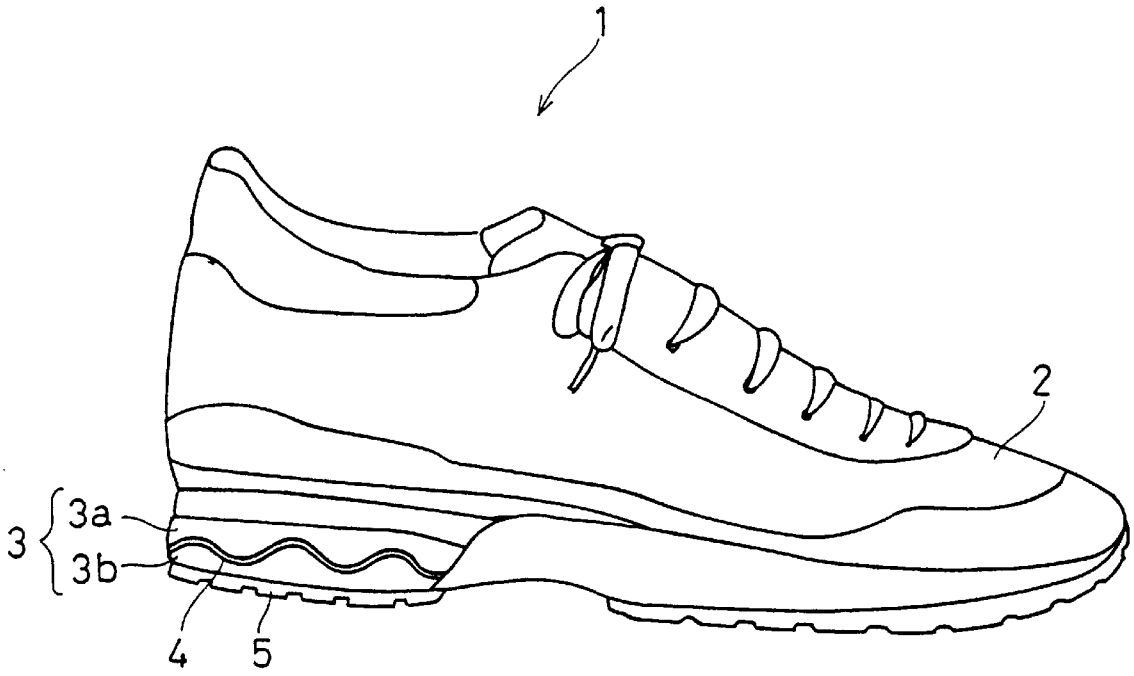
FIG. 1 is a side view of an athletic shoe incorporating the present invention midsole construction.

Turning now to the drawings, FIG. 1 illustrates an athletic shoe incorporating a midsole construction of the present invention. The sole of this athletic shoe 1 comprises a midsole 3, a corrugated sheet 4 and an outsole 5 directly contacting the ground. The midsole 3 is fitted to the bottom of uppers 2. The corrugated sheet 4 is disposed in the midsole 3. The outsole 5 is fitted to the bottom of the midsole 3.

Figure 2:
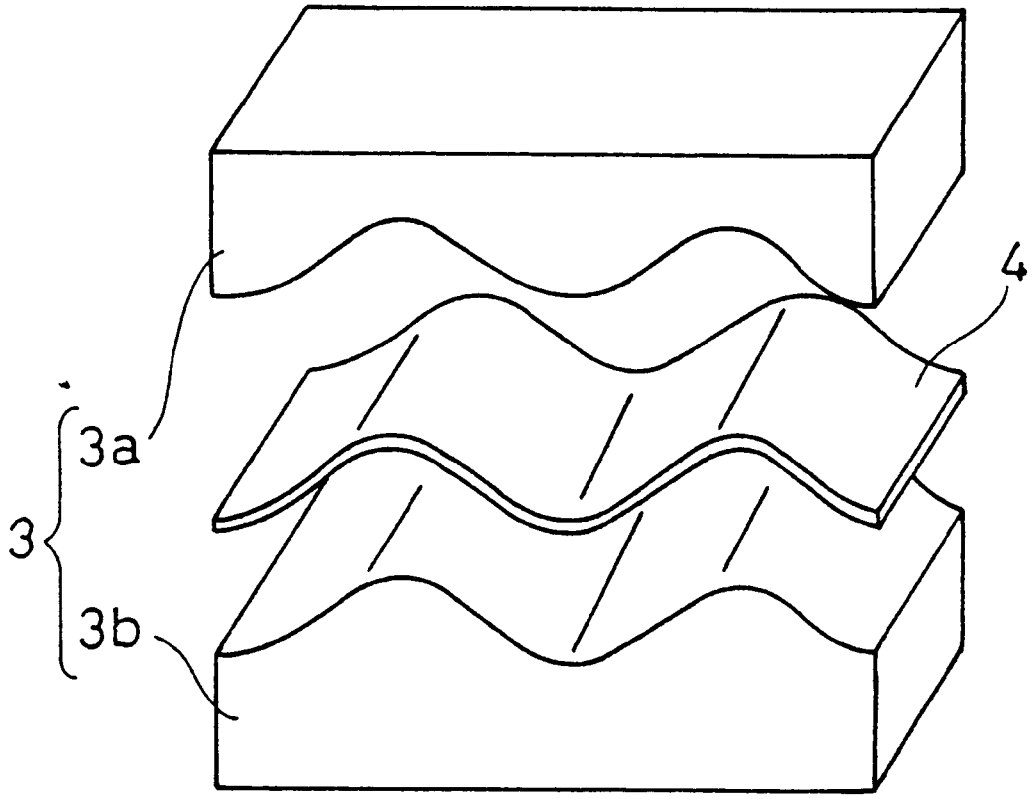
FIG. 2 is an exploded, perspective view of a portion of the midsole construction of the present invention.

The midsole 3 is provided in order to absorb a shock load imparted on the heel portion of the shoe 1 when landing on the ground. As shown also in FIG. 2, the midsole 3 is comprised of an upper midsole 3*a* and a lower midsole 3*b* which are respectively disposed on the top and bottom surfaces of the corrugated sheet 4.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber are used.

When the midsole construction of the present invention is applied to a typical athletic shoe, foam having about 1–100 kg/cm$^2$, preferably about 10 kg/cm$^2$, of the modulus of elasticity is utilized as the foam for forming the midsole 3.

The corrugated sheet 4 is formed of thermoplastic resin such as thermoplastic polyurethane(TPU) of comparatively rich elasticity, polyamide elastomer (PAE), ABS resin and the like. Alternatively, the corrugated sheet 4 is formed of thermosetting resin such as epoxy resin, unsaturated polyester resin and the like.

For example, when the midsole construction of the present invention is applied to a typical athletic shoe a thermoplastic polyurethane sheet of about 1 mm thickness, having about 100–50000 kg/cm$^2$. preferably about 1000 kg/cm$^2$, of the modulus of elasticity is utilized as the corrugated sheet 4.

As described above, in the present invention midsole construction the corrugated sheet 4 is interposed between the upper midsole 3*a* and the lower midsole 3*b*, and the sheet 4 is integrated with the midsole 3*a* and 3*b*.

In this midsole construction the pressure imparted from the upper midsole 3*a* in landing is dispersed by the corrugated sheet 4 and the pressured area of the lower midsole 3*b* becomes enlarged. As a result, compressive hardness throughout the midsole construction is made higher.

Generally, the compressive hardness is determined by bending rigidity EI (E: Young's modulus, I: moment of inertia of area) of the material forming the corrugated sheet 4.

Figure 3:
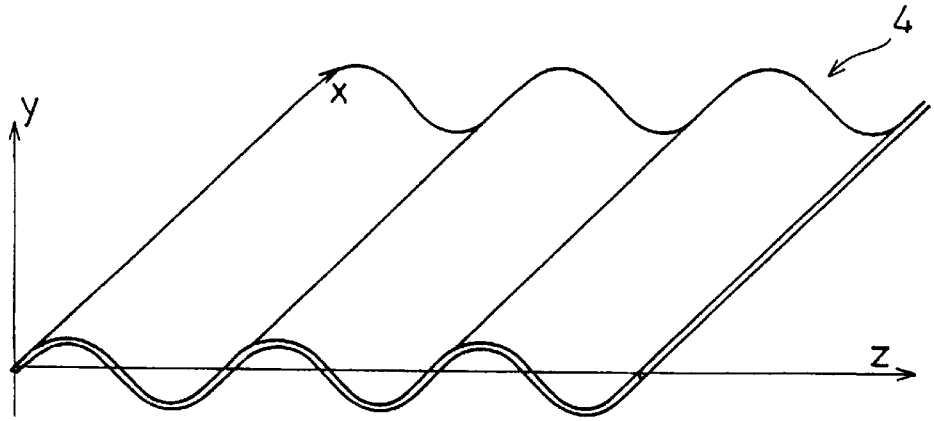
FIG. 3 is a perspective view of a portion of a corrugated sheet in the midsole construction of the present invention.

Now, as shown in FIG. 3, take the coordinate system over the corrugated sheet 4 and consider that the bending moment M around the z-axis is imparted to the corrugated sheet 4.

Figure 4:
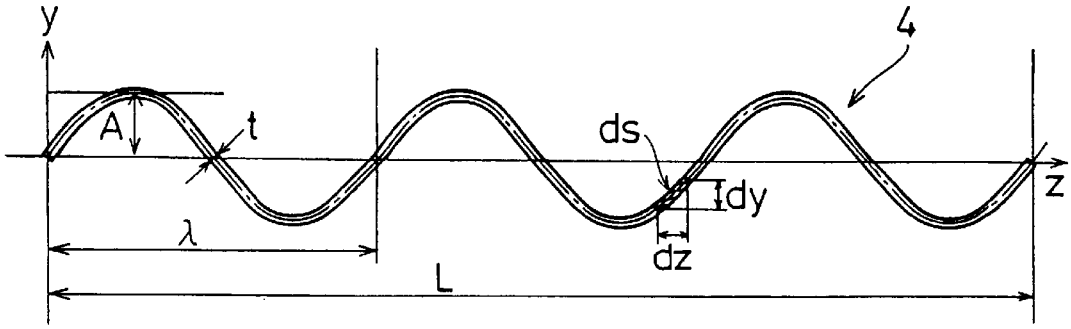
FIG. 4 is a side sectional view of the corrugated sheet.

Supposing the corrugated sheet 4 is formed by bending a sheet of t in thickness into sine curved configuration of amplitude A and wavelength λ, the vertical cross sectional view of the corrugated sheet 4 is shown in FIG. 4. The wave configuration of this cross section can be expressed by the following equation 1.

$$y = A\sin\left(\frac{2\pi z}{\lambda}\right)$$

When there is a relation of L=nλ(L: the whole length of the corrugated sheet 4, n: natural number), the neutral axis of this section is y=0. The moment of inertia of area I of this section with relation to the neutral axis can be expressed by the following equation 2 when a minute area on the section is ds.

$$I = \int_0^L y^2\,ds$$

$$= \frac{tLA^2}{\lambda}\int_0^\lambda \sin^2\left(\frac{2\pi z}{\lambda}\right)\sqrt{1+\left(\frac{2\pi A}{\lambda}\right)^2\cos^2\left(\frac{2\pi z}{\lambda}\right)}\,dz$$

-continued $$= \frac{2\pi tLA^3}{\lambda^2}\int_0^\lambda \sin^2\left(\frac{2\pi z}{\lambda}\right)\sqrt{\left(\frac{\lambda}{2\pi A}\right)+\cos^2\left(\frac{2\pi z}{\lambda}\right)}\,dz$$

Figure 5:
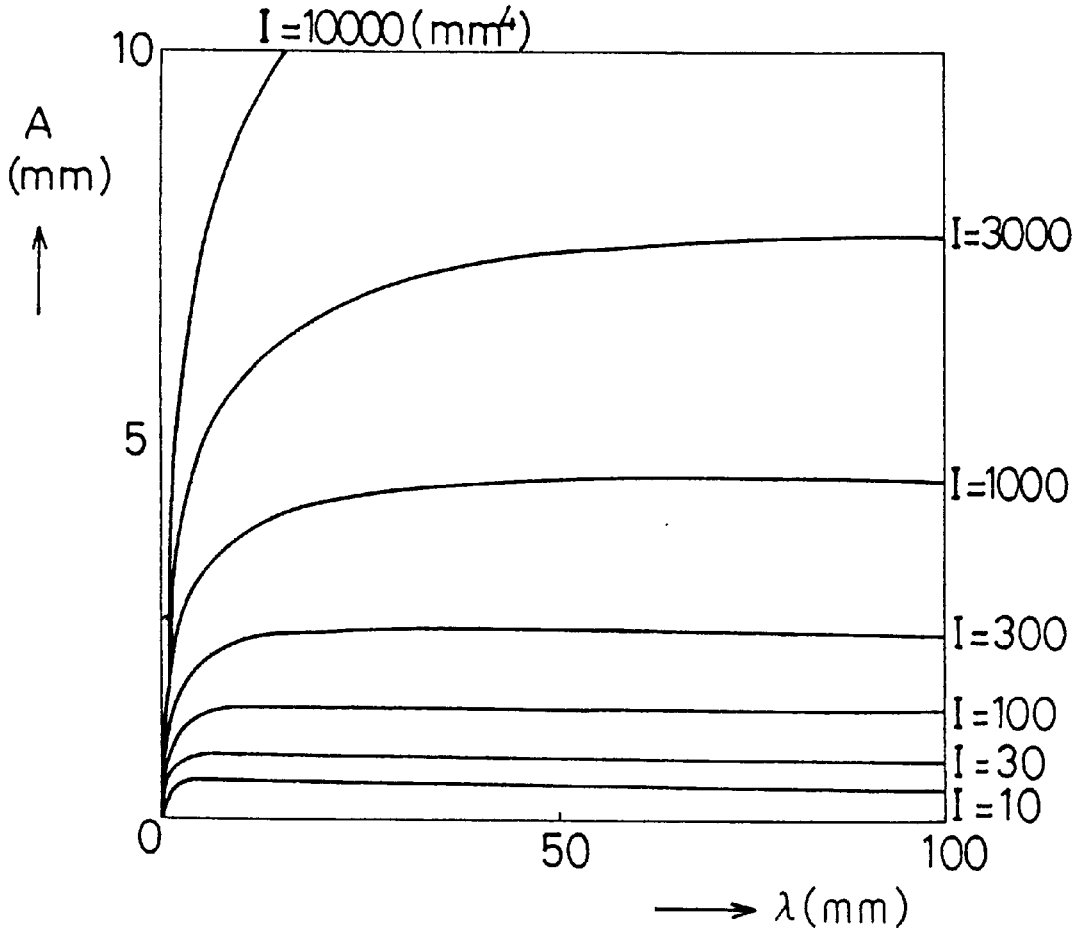
FIG. 5 is a graph showing the relations between moment of inertia of area I, wavelength λ and amplitude A of the corrugated sheet.

The relations between wavelength λ, amplitude A and moment of inertia of area I are shown in FIG. 5 as t=1(mm), L=100(mm). As seen from FIG. 5, amplitude Asolely contributes moment of inertia of area I and wavelength λ seldom does when wavelength λ exceeds a certain value.

When it is confirmed by the equation, the equation 2 would be as follows in the case of λ>>A.

$$I \approx \frac{tLA^2}{2}$$

This equation 3 shows that moment of inertia of area I is proportional to the square of amplitude A but wavelength λ does not influence moment of inertia of area I at all when wavelength λ is adequately large compared to amplitude A.

On the other hand, the equation 2 would be as follows in the case of A>>λ.

$$I \approx \frac{4tLA^2}{3\lambda}$$

This equation 4 shows that moment of inertia of area I is proportional to the cube of amplitude A and inversely proportional to wavelength λ when wavelength λ is adequately small compared to amplitude A.

In fact, influence of amplitude A and wavelength λ upon moment of inertia of area I would be the intermediate between the above equations 3 and 4. In either case, influence of amplitude A upon moment of inertia of area I is extremely large compared to wavelength λ.

Figure 6:
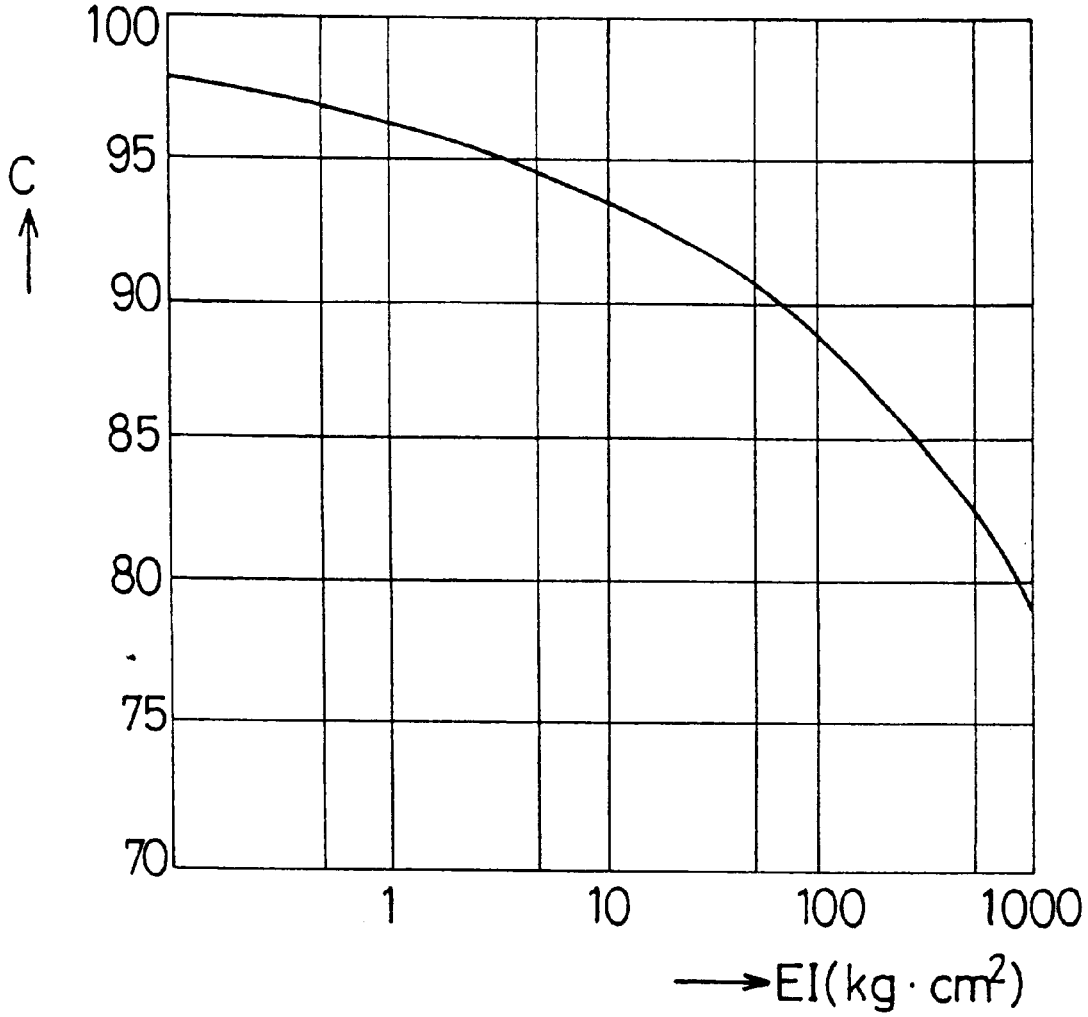
FIG. 6 is a graph showing the relations between bending rigidity EI and cushioning coefficient C of the midsole having a corrugated sheet therein.

Next, FIG. 6 shows the relation between bending rigidity EI and cushioning properties. In FIG. 6, C axis of ordinate represents cushioning coefficient. The cushioning coefficient C represents cushioning properties of the midsole 3 having the corrugated sheet 4 therein. The coefficient C is a comparative value when compressive deformation of a midsole 3 without a corrugated sheet, to which a predetermined load is applied, is the basic value of 100. As seen from FIG. 6, as the bending rigidity EI becomes larger, the cushioning coefficient C becomes smaller and cushioning properties become poor, but stability is improved.

Therefore, where stability on landing is required in the midsole 3 the compressive hardness should be increased by enlarging the moment of inertia of area I and thus the bending rigidity EI through enlarging the amplitude A and decreasing the wavelength λ. On the contrary, where cushioning properties on landing are required in the midsole 3 the compressive hardness should be decreased by decreasing the moment of inertia of area I and thus the bending rigidity EI through decreasing the amplitude A and enlarging the wavelength λ.

In this way, by properly adjusting amplitude A and wavelength λ, bending rigidity EI can be adjusted, and thus compressive hardness of the whole midsole construction will come to be adjusted.

Alternatively, since compressive hardness of the whole midsole construction is generally determined by the amplitude A rather than the wavelength λ of the corrugated sheet 4, regulation of compressive hardness may be made solely by the amplitude A, and regulation of the bending deformation properties of the midsole construction(i.e. how the midsole construction deforms in landing along the ridge line or ravine line of the wave configuration of the corrugated sheet) may be made by the wavelength λ.

Necessary procedures for forming the above midsole construction are as follows. The values in the following description are merely examples and the present invention is not limited to these examples.

Method 1

First, a flat sheet 3*b*' (see FIG. 7) of about 10–20 mm thickness, made of soft elastic material, is cut along the circumference of the heel of an athletic shoe. This flat sheet 3*b*' will constitute the lower midsole 3*b* after forming process has been completed.

Then, a flat sheet 4' (see FIG. 7) of about 0.5–2 mm thickness, made of thermoplastic or thermosetting resin, is cut into a slightly smaller circumferential configuration than that of the heel. This flat sheet 4' will constitute the substantial(or functional) corrugated sheet 4 after forming. A flat sheet 4" (see FIG. 7) of about 0.5–2 mm thickness, made of soft elastic material, is cut along the circumference of the heel. This flat sheet 4" will constitute the seeming(or appearing) corrugated sheet 4 after forming.

In addition, the flat sheet 4" has preferably different color or design from that of the flat sheet 3*b*' such that the circumferential end surface of the flat sheet 4" can be distinguished from that of the lower midsole 3*b* after forming process has been completed.

Figure 7:
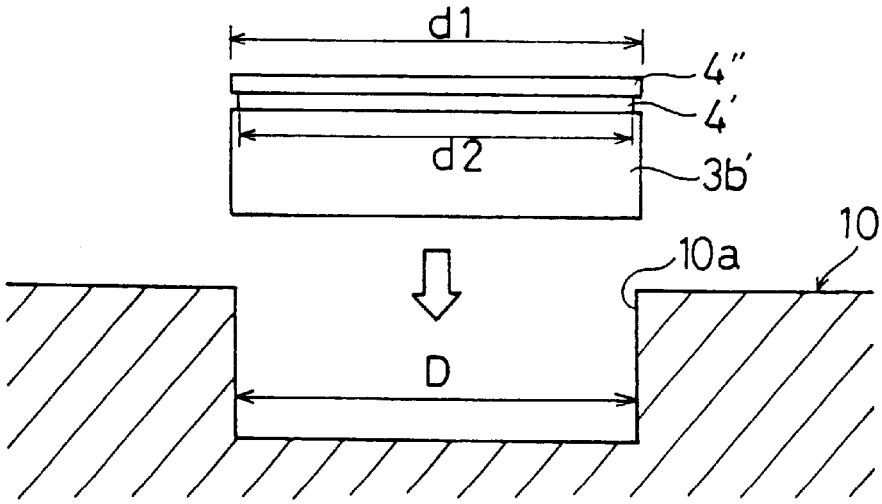
FIG. 7–12 are schematics illustrating a forming process of the midsole construction of the present invention.
Figure 8:
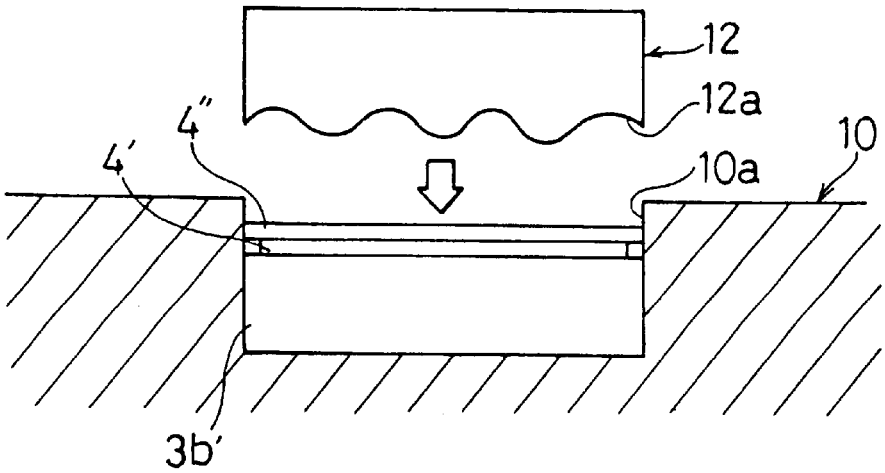

Second, the flat sheets 4' and 4" are bonded onto the upper surface of the flat sheet 3*b*' (see FIG. 7) and then, as shown in FIG. 8. these flat sheets 3*b*', 4' and 4" are inserted into a cavity 10*a* of a mold 10. In FIG. 7 the flat sheets 4' and 4" are placed on the flat sheet 3*b*' sequentially, but the flat sheets 4' and 4" may be adversely placed. In addition, in FIGS. 7 and 8 (also in FIGS. 9 to 12), each thickness of the flat sheets 4' and 4" is shown exaggeratingly for the purpose of clarification.

The outer measurement d1 of the flat sheets 3*b*' and 4" is larger than the inner measurement D of the cavity 10*a*. However, since the flat sheets 3*b*' and 4" formed of soft elastic material have smaller modulus of elasticity and are easy to be deformed, these flat sheets 3*b*' and 4" are easy to be inserted into the cavity 10*a*.

On the other hand, the flat sheet 4' formed of thermoplastic or thermosetting resin has larger modulus of elasticity and is hard to be deformed. However, since the outer measurement d2 of the flat sheet 4' is slightly smaller than the inner measurement D of the cavity 10*a*, the flat sheet 4' is also easy to be inserted into the cavity 10*a*.

Figure 9:
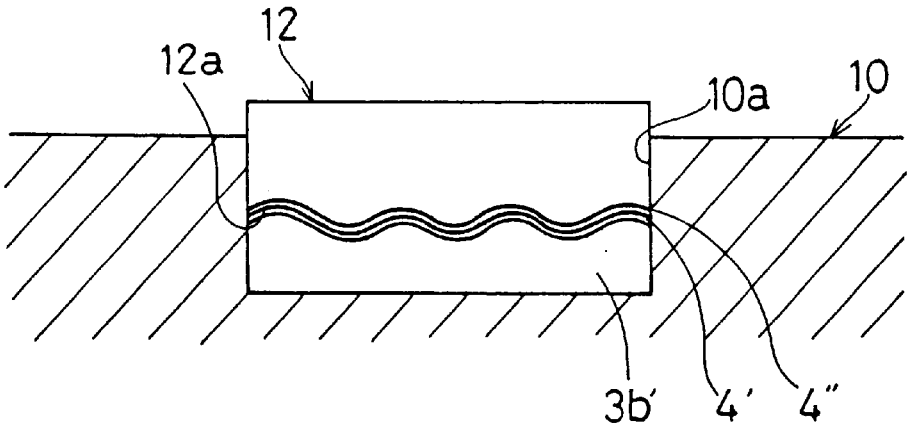
Figure 10:
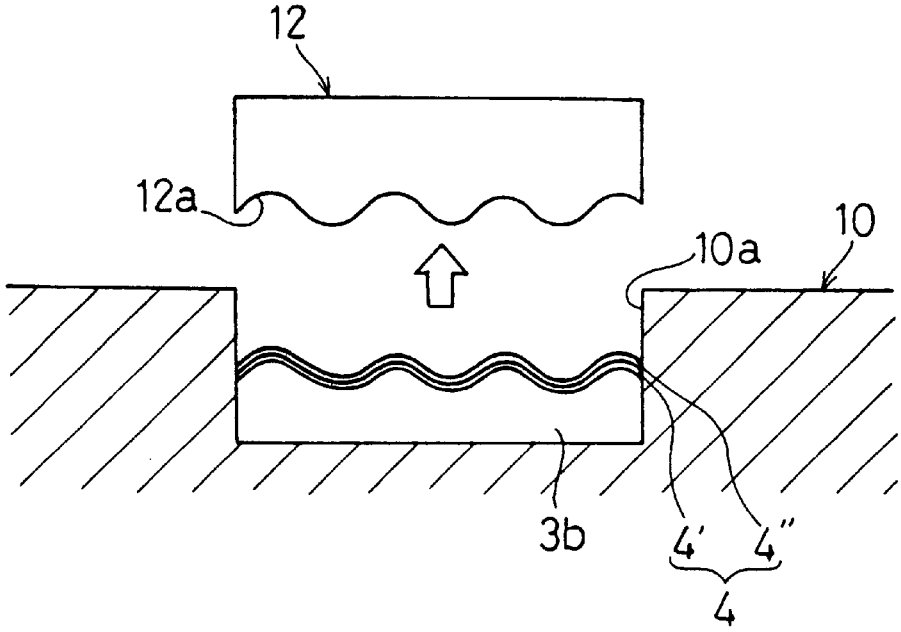

Next, as shown in FIGS. 8 and 9, the mold 12 having a corrugated bottom surface 12*a* is inserted into the cavity 10*a* of the mold 10, and then pressed and heated. When the mold 12 has returned after this thermoforming, as shown in FIG. 10, the lower midsole 3*b* having a corrugated upper surface is obtained and also, the corrugated sheet 4 formed of the flat sheets 4' and 4", is obtained.

In addition, a flat sheet of about 10–20 mm thickness, made of soft elastic material, is cut along the circumference of the heel of an athletic shoe, as in the case of forming the lower midsole 3*b*. Then, by inserting this cut sheet into a mold set, one of which has a corrugated surface, pressing and heating it, the upper midsole 3*a* having a flat top surface and a corrugated bottom surface is formed through thermoforming. The maximum thickness of the upper midsole 3*a* after forming is set about 10–15 mm.

Figure 11:
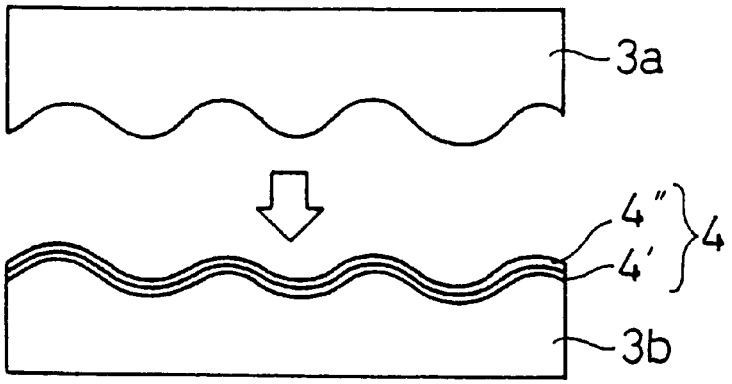
Figure 12:
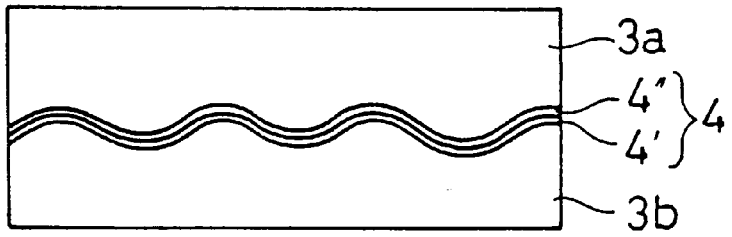

Then, by bonding the corrugated surface of the upper midsole 3*a* onto the corrugated sheet 4 on the lower midsole 3*b* and integrating them, the midsole construction of the present invention is completed (see FIGS. 11 and 12).

Before thermoforming the lower midsole 3*b* and the corrugated sheet 4, as abovementioned, the circumferential end surface of the flat sheet 4' is receded inwardly from the circumferential end surfaces of the flat sheets 3*b*' and 4". Therefore, after thermoforming, the circumferential end surface of the flat sheet 4' constituting the substantial corrugated sheet 4 is buried inside the circumferential end surfaces of the lower midsole 3*b* and flat sheet 4", and hard to be distinguished from outside.

However, after forming, the circumferential end surface of the flat sheet 4" contacting tightly with the flat sheet 4' is placed at the same position as the side surface of the heel, and besides, the flat sheet 4" has a different color or design from that of the lower midsole 3*b*. Thus, the consumers and users of shoes can distinguish the corrugated sheet by the existence of the sheet 4" and as a result, aesthetic impression of shoes will be improved.

In FIGS. 7–12, the corrugated sheet 4 is comprised of the flat sheet 4' formed of thermoplastic or thermosetting resin and the flat sheet 4" formed of soft elastic material. However, the corrugated sheet 4 may be comprised solely of the flat sheet 4'.

In this case, by enlarging the outer measurement of the flat sheet 4', the circumferential end surface of the formed flat sheet 4' or the corrugated sheet 4 should be preferably seen from outside. However, since the flat sheet 4' has larger modulus of elasticity and is hard to deform, the outer circumference of the enlarged flat sheet 4' cannot enter the cavity of a mold and as a result, burrs will occur around the outer circumference of the formed flat sheet 4'. Therefore, in this case, removal procedures of the burrs are required.

Method 2

In the above method 1 there is shown a method wherein after bonding the flat sheet constituting the corrugated sheet 4 onto the upper surface of the lower midsole 3*b* the flat sheet and the upper surface of the lower midsole 3*b* are formed into corrugated configuration. But the present invention is not limited to this method.

After forming the flat sheet and the upper surface of the lower midsole 3*b* Into corrugated configuration respectively and separately, the corrugated sheet 4 may be interposed between the lower corrugated surface of the upper midsole 3*a* and the upper corrugated surface of the lower midsole 3*b*, and the sheet 4 may be bonded between the midsoles 3*a* and 3*b*.

In this case, a flat. sheet of about 10–20 mm thickness, formed of soft elastic material, is cut along the circumferential configuration of the heel.

Then, by inserting this cut flat sheet into a mold set, one of which has a corrugated surface, and pressing and heating it, the upper midsole 3*a* having a generally flat upper surface and a corrugated bottom surface is formed through thermoforming. The maximum thickness of the formed upper midsole 3*a* is set about 5–7 mm.

Similarly, a flat sheet of about 10–20 mm thickness, formed of soft elastic material, is cut along the circumferential configuration of the heel. Then, by inserting this cut flat sheet into a mold set, one of which has a corrugated surface, and pressing and heating it, the lower midsole 3*b* having a generally flat bottom surface and a corrugated upper surface is formed through thermoforming. The maximum thickness of the formed lower midsole 3*b* is set about 10–15 mm.

On the other hand, the corrugated sheet 4 may be formed through either thermoforming or injection molding. In the case of thermoforming, by inserting such a laminate of the flat sheets 4' and 4" (or only the flat sheet 4') as was explained in the method 1 into a mold set, both of which have corrugated surfaces, and pressing and heating it, the corrugated sheet 4 is obtained. In the case of injection molding, by introducing the molten thermoplastic resin into the injection mold having a corrugated surface, the corrugated sheet 4 is obtained.

Then, by interposing the corrugated sheet 4 between the corrugated surface on the bottom side of the upper midsole 3*a* and the corrugated surface on the top side of the lower midsole 3*b*. contacting the corrugated sheet 4 with both of the corrugated surfaces of the upper and lower midsoles 3*a*, 3*b*, and integrating them together, the midsole construction is obtained.

Method 3

The method 3 is entirely different from the abovementioned methods 1 and 2.

First, the corrugated sheet 4 is formed by thermoforming or injection molding and the formed corrugated sheet 4 is placed in a mold. Then, premixed polyurethane foam material is introduced into the mold and foamed in it. Thus, the upper midsole 3*a* and lower midsole 3*b* are formed integral with the upper and lower surfaces of the corrugated sheet 4 and the midsole construction is completed.

In the midsole construction formed by the abovementioned processes, a shoe sole is constituted by bonding the outsole 5 on the bottom surface of the lower midsole 3*b*. The outsole 5 is mainly comprised of solid rubber and its landing surface has a plurality of slip preventive grooves or projections.

In addition, a shank member made of hard rigid resin or metal may be installed on the medial and lateral portions of the midfoot portion (or the arch portion) of the midsole construction in order to increase rigidity. Additionally, a member such as a stabilizer and the like may be provided between the upper midsole 3*a* and the vamp 2 so as to improve the stability of the heel portion.

Referring to FIGS. 13–22, there are shown various kinds of midsole constructions of the present invention.

Figure 13:
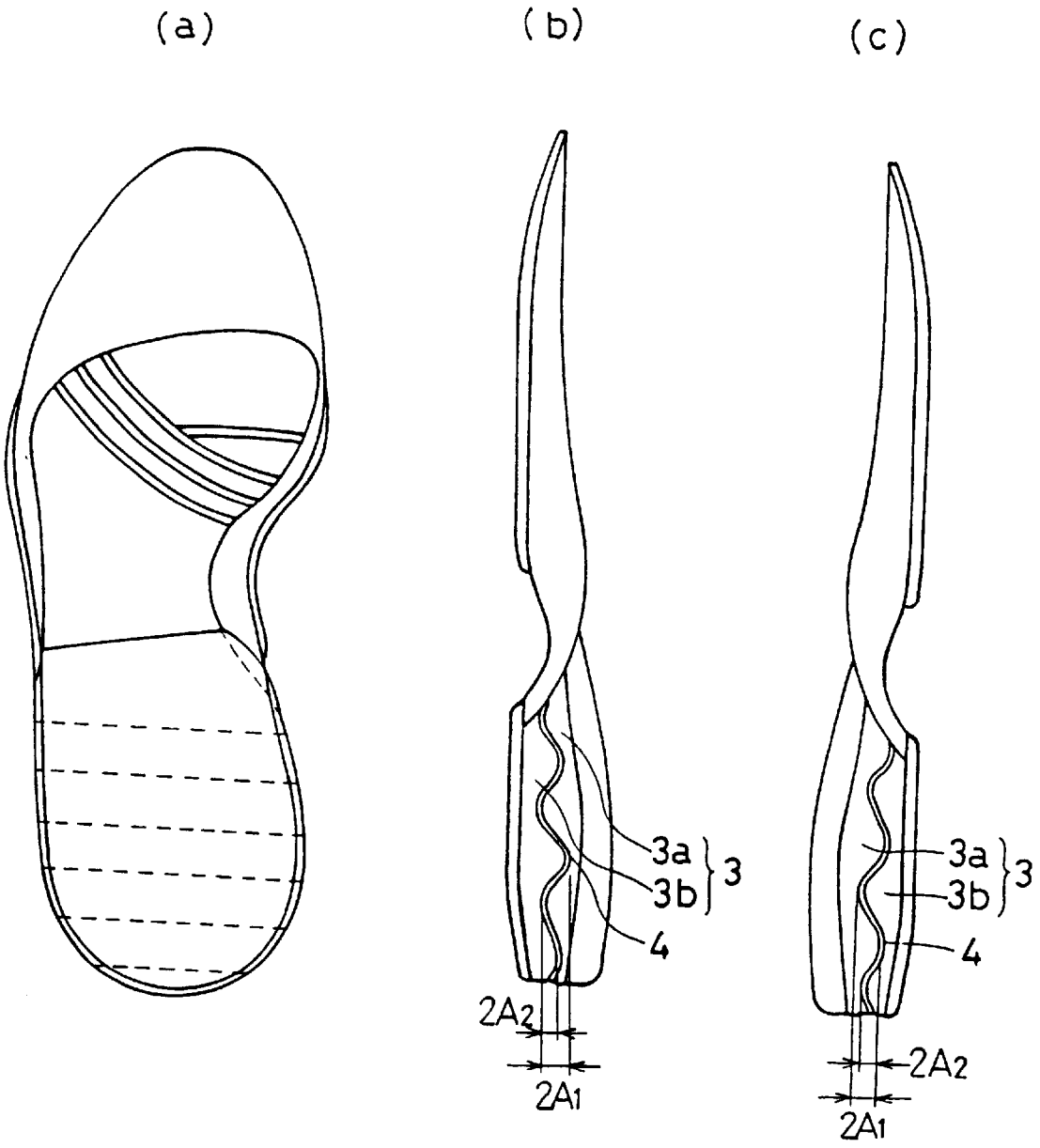
FIG. 13–19 are schematics illustrating the midsole construction of the present invention. In each Figure, (a) is a top plan view of the midsole construction of a left side shoe; (b) is an outside side view thereof; (c) is an inside side view thereof.

In the embodiment shown in FIG. 13, the following relation exists between the amplitudes A1 and A2.

$$2\,A1 > 2\,A2 \text{ or } A1 > A2$$

A1: the amplitude at the heel front end portion of the wave configuration of the corrugated sheet 4;

A2: the amplitude at the heel back end portion of the wave configuration of the corrugated sheet 4.

That is to say, in this case, since the amplitude of the wave configuration of the corrugated sheet 4 is smaller at the back end side of the heel portion and greater at the front end side of the heel portion, adequate cushioning of the midsole 3 is sustained at the back end side heel portion of the smaller amplitude and compressive hardness of the midsole 3 is made higher at the front end side heel portion of the greater amplitude. As a result, in the athletics where athletes land more frequently at the back end side of their heel portions, shock load in landing can be effectively eased at the heel back end side portion and cushioning properties can be ensured, and besides, the heel portions of the midsoles can be prevented from being deformed transversely after landing.

In addition, after landing, when the load moves toward the heel front end side portion of higher compressive hardness, the excessive sinking of the heel portion can be restrained, and thus, as the athletes move on to the next movements, loss in the athletic power can be decreased.

Figure 14:
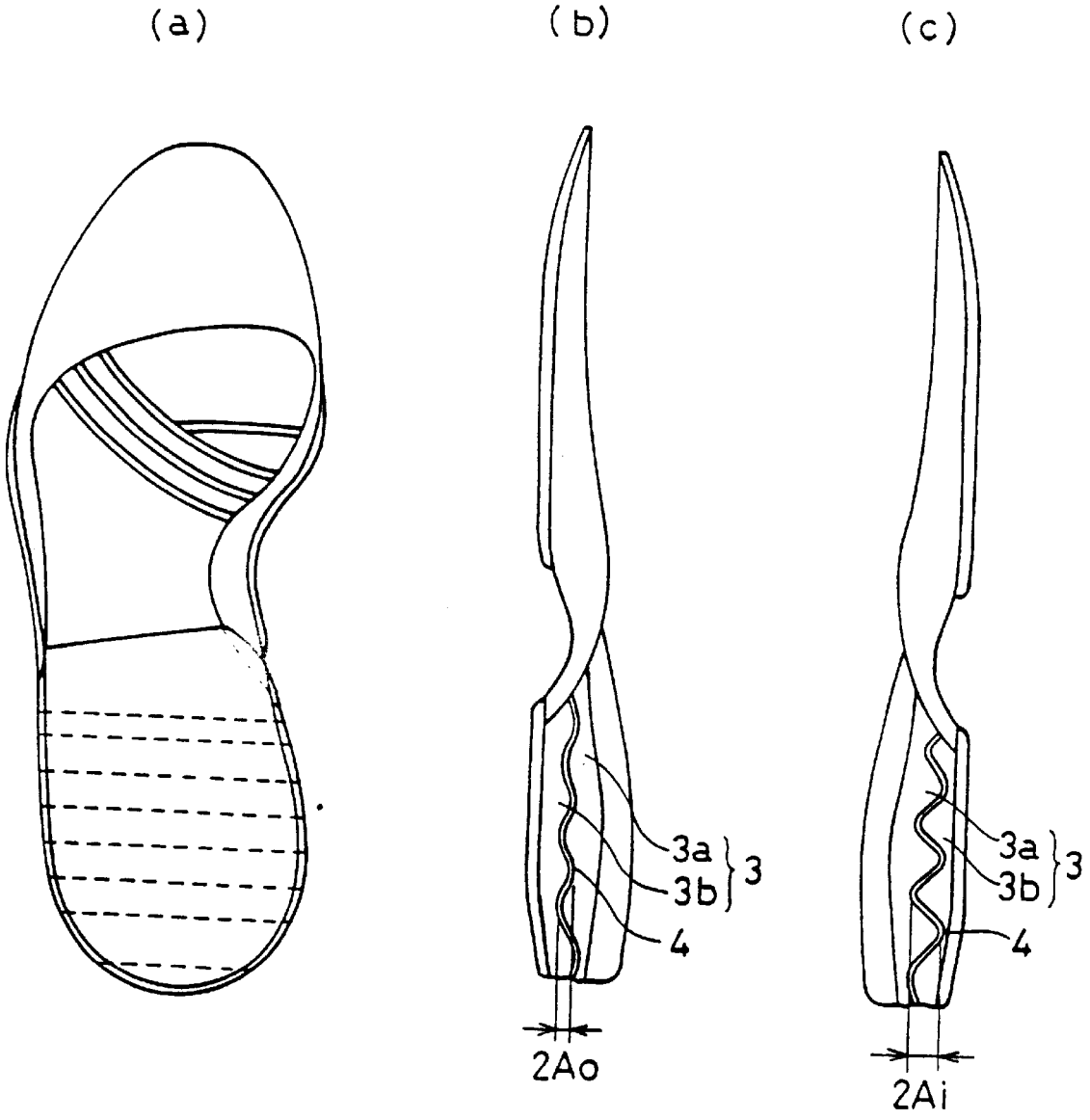

In the embodiment shown in FIG. 14, the following relation exists between the amplitudes Ai and Ao.

$$2\,Ai > 2\,Ao \text{ or } Ai > Ao$$

Ai : the amplitude at the heel medial portion of the wave configuration of the corrugated sheet 4;

Ao : the amplitude at the heel lateral portion of the wave configuration of the corrugated sheet 4.

That is to say, in this case, since the amplitude of the wave configuration of the corrugated sheet 4 is greater at the medial side of the heel portion and smaller at the lateral side of the heel portion, adequate cushioning of the midsole 3 is sustained at the heel lateral portion of the smaller amplitude and compressive hardness of the midsole 3 is made higher at the heel medial portion of the greater amplitude. As a result, in the athletics where athletes land more frequently at the lateral side of their heel portions, shock load in landing can be effectively eased at the heel lateral portions and cushioning properties can be ensured. Moreover, when a foot is about to lean toward the heel medial portion after landing, the foot can be supported by the heel medial portion of the midsole and the heel portion of the midsole can be prevented from being deformed transversely after landing.

In addition, after landing, when the heel of a foot has pronated, the excessive sinking of the heel portion of a foot toward the midsole medial portion can be prevented by the heel medial portion of higher compressive hardness, and thus, over-pronation can be prevented.

Figure 15:
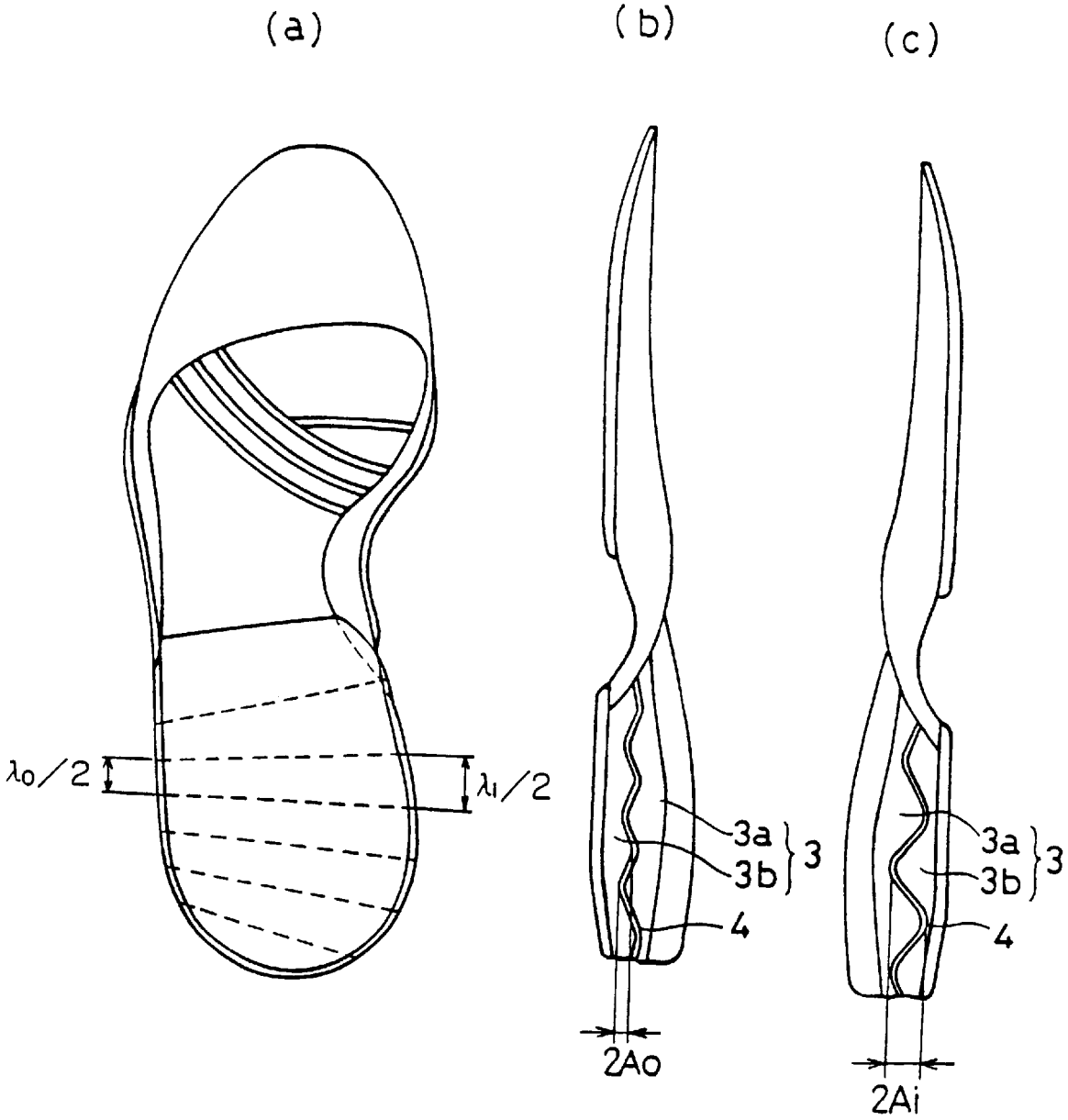

In the embodiment shown in FIG. 15, the following relation exists between the amplitudes Ai, Ao as in the embodiment shown in FIG. 14.

$$Ai > Ao$$

Moreover, the following relation also exists between the wavelengths $\lambda$ i and $\lambda$ o.

$$\lambda\, i/2 > \lambda\, o/2 \text{ or } \lambda\, i > \lambda\, o$$

$\lambda$ i: the wavelength at the heel medial portion of wave configuration of the corrugated sheet 4;

$\lambda$ o: the wavelength at the heel lateral portion of wave configuration of the corrugated sheet 4.

In this embodiment, as in the embodiment shown in FIG. 14, since the amplitude of wave configuration of the corrugated sheet 4 is greater at the heel medial portion and smaller at the heel lateral portion, in the athletics where athletes land more frequently at the lateral side of their heel portions, cushioning can be ensured and the heel portion of the midsole can be prevented from being deformed transversely after landing.

Moreover, in this case, the wavelength of wave configuration of the corrugated sheet 4 is greater at the heel medial portion and smaller at the heel lateral portion. In the athletics where athletes land more frequently at their heel lateral portions, when they land on the ground from the heel portions toward the toe portions of the shoes in sequence, the load path (or the load carrying path) can nearly coincide with the direction perpendicular to each ridge line of wave configuration. The direction of each ridge line or generating line is shown by x in FIG. 3 and the direction perpendicular to each ridge line or director line is shown by z in FIG. 3. In this case, the midsole 3 deforms along the ridge lines or ravine lines of wave configuration when landing.

As a result, the transverse deformation and the over-pronation at the heel portion can be securely prevented and the larger contact area can be secured when landing. Thus, grip properties and wear resistant properties can be improved.

When this midsole construction is applied to a typical athletic shoe, each measurement is set as follows:

e.g.) Ai=6(mm), Ao=3.25(mm), λi=40(mm), λo=25mm

Figure 16:
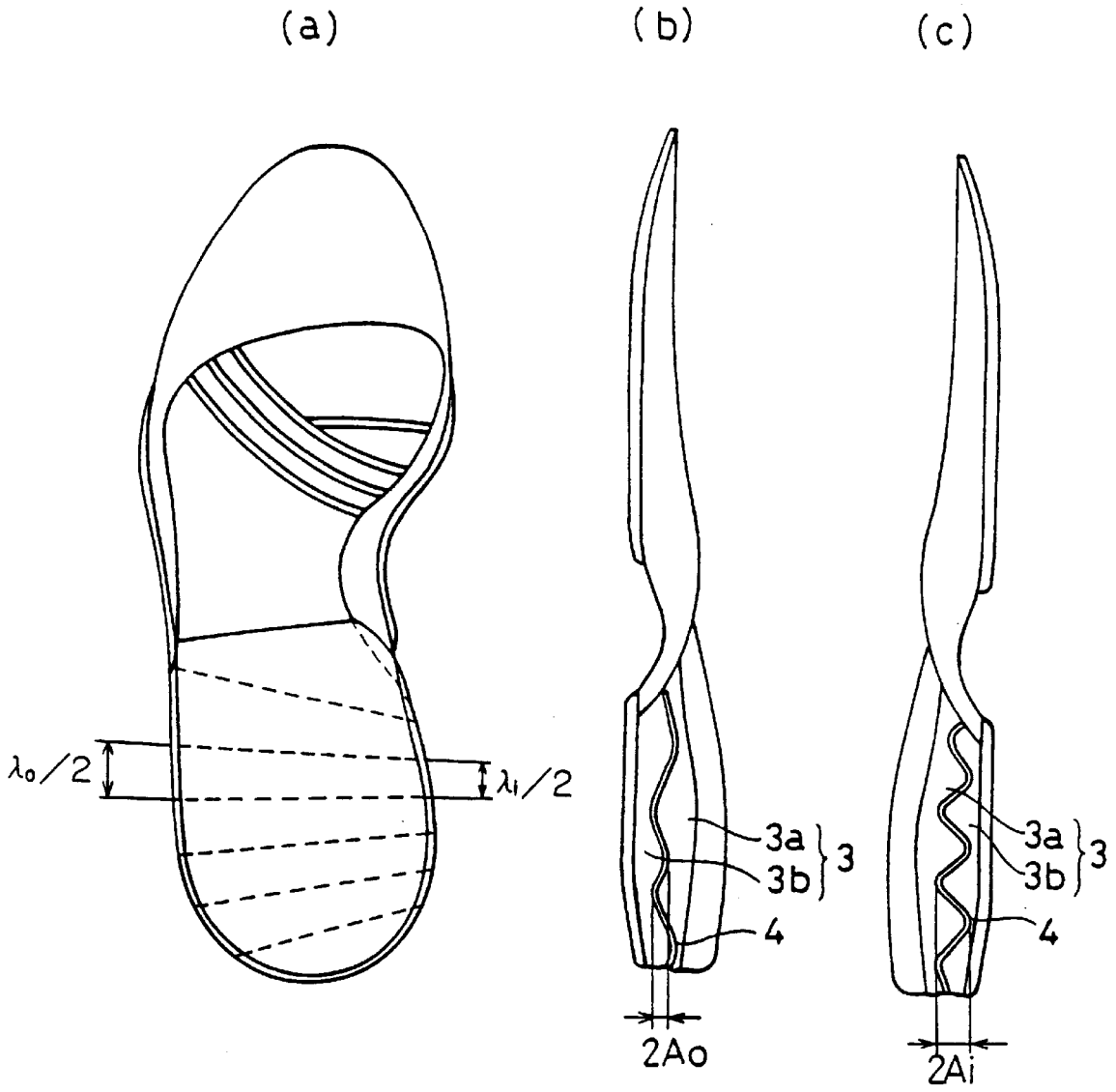

In the embodiment shown in FIG. 16, the following relation exists between the amplitudes Ai, Ao as in the embodiment shown in FIG. 14.

Ai>Ao

Moreover, the following relation also exists between the wavelengths λ i and λ o, different from the embodiment in FIG. 15.

λo/2>λi/2or λo>λi

In this case, the wavelength of wave configuration of the corrugated sheet 4 is greater at the heel lateral portion and smaller at the heel medial portion. In the athletics where athletes land more frequently at their heel medial portions, when they land on the ground from the heel portions toward the toe portions of the shoes in sequence, the load path can nearly coincide with the direction perpendicular to each ridge line of wave configuration.

As a result, the transverse deformation and the over-pronation at the heel portion can be securely prevented and the larger contact area can be secured when landing. Thus, grip properties and wear resistant properties can be improved.

Figure 17:
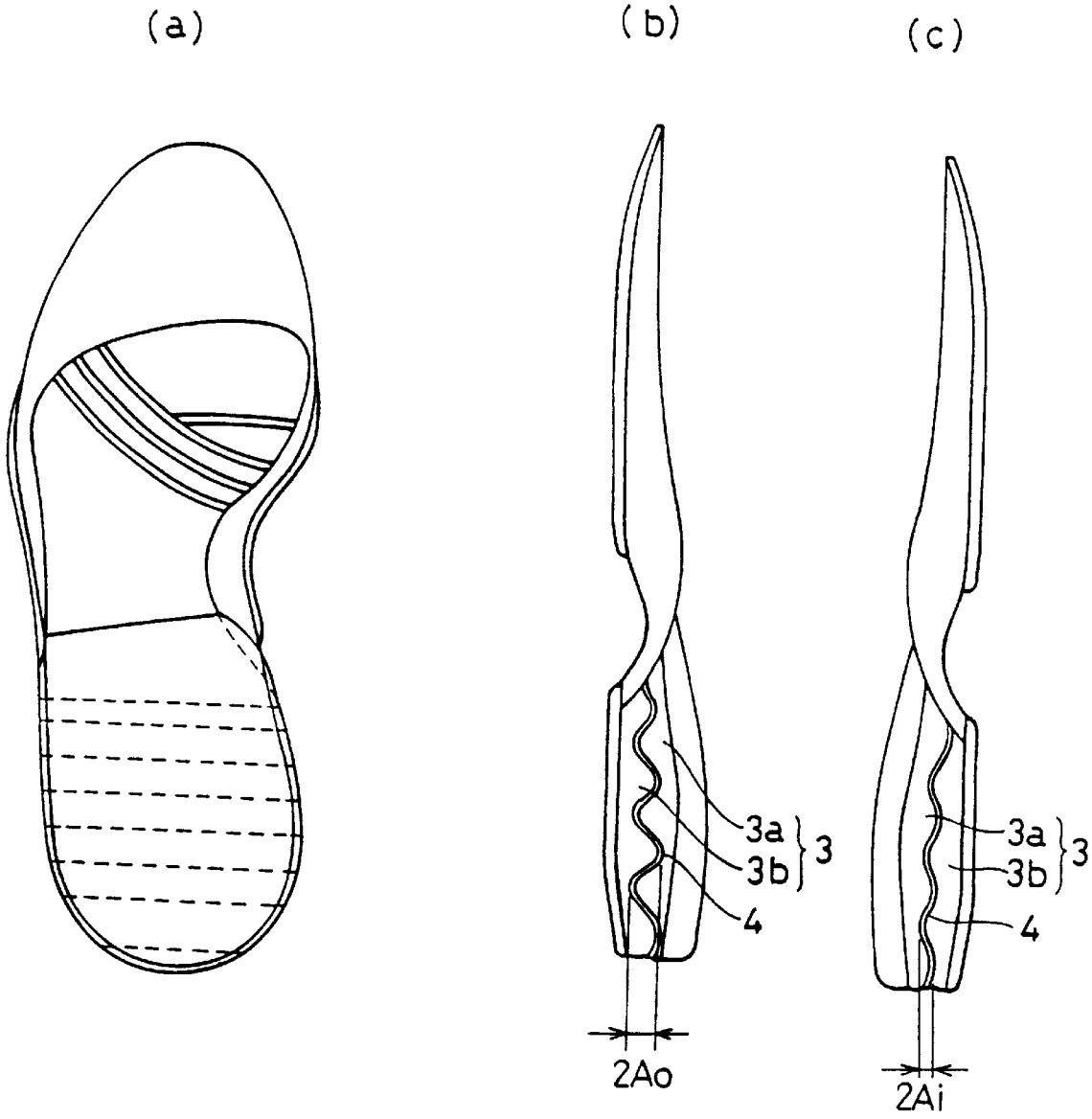

In the embodiment shown in FIG. 17, the following relation exists between the amplitudes Ai and Ao, different from the embodiment in FIG. 14.

2Ao>2Ai or Ao>Ai

That is to say, in this case, since the amplitude of wave configuration of the corrugated sheet 4 is greater at the lateral side of the heel portion and smaller at the medial of the heel portion, adequate cushioning of the midsole 3 is sustained at the heel medial portion of the smaller amplitude and compressive hardness of the midsole 3 is made higher at the heel lateral portion of the greater amplitude.

As a result, in the athletics where athletes land more frequently at the their heel medial portions, shock load in landing can be effectively eased at the heel medial portions and cushioning can be ensured. Moreover, when a foot is about to lean toward the heel lateral portion after landing the foot can be supported by the heel lateral portion of the midsole and the heel portion of the midsole can be prevented from being deformed transversely after landing.

In addition, after landing, when the heel of a foot has supinated, excessive sinking of the heel portion of a foot can be restrained by the heel lateral portion of higher compressive hardness, and over-supination can be prevented.

Figure 18:
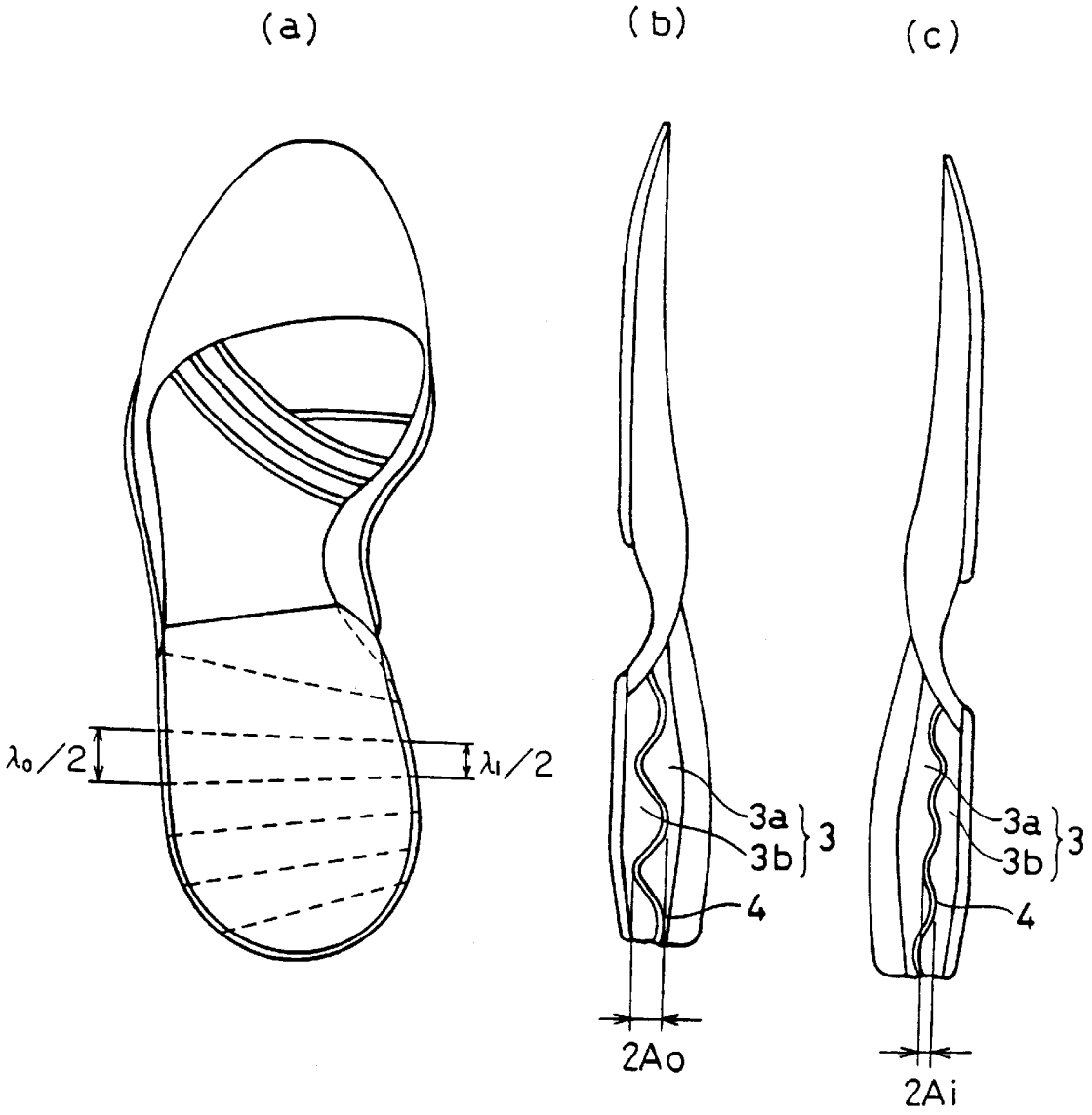

In the embodiment shown in FIG. 18, the following relation exists between the amplitudes Ai, Ao as in the embodiment shown in FIG. 17.

Ao>Ai

Moreover, the following relation also exists between the wavelengths λi and λo.

λo/2>λi/2 or λo>λi

In this case, since the amplitude of wave configuration of the corrugated sheet 4 is greater at the lateral side of the heel portion and smaller at the medial side of the heel portion, as in the embodiment shown in FIG. 17, in the athletics where athletes land more frequently at the medial side of their heel portions, cushioning can be ensured and the heel portion of the midsole can be prevented from being deformed transversely after landing.

Furthermore, in this embodiment, the wavelength of wave configuration of the corrugated sheet 4 is greater at the heel lateral portion and smaller at the heel medial portion. Therefore, in the athletics where athletes land more frequently at their heel medial portions when they land on the ground from the heel portions toward the toe portions of the shoes in sequence, the load path can nearly coincide with the direction perpendicular to each ridge line of wave configuration. That is to say, the midsole 3 deforms along the ridge lines or ravine lines of wave configuration when landing.

As a result, the transverse deformation and the over-supination at the heel portion can be securely prevented and the larger contact area can be secured when landing. Thus, grip properties and wear resistant properties can be improved.

Figure 19:
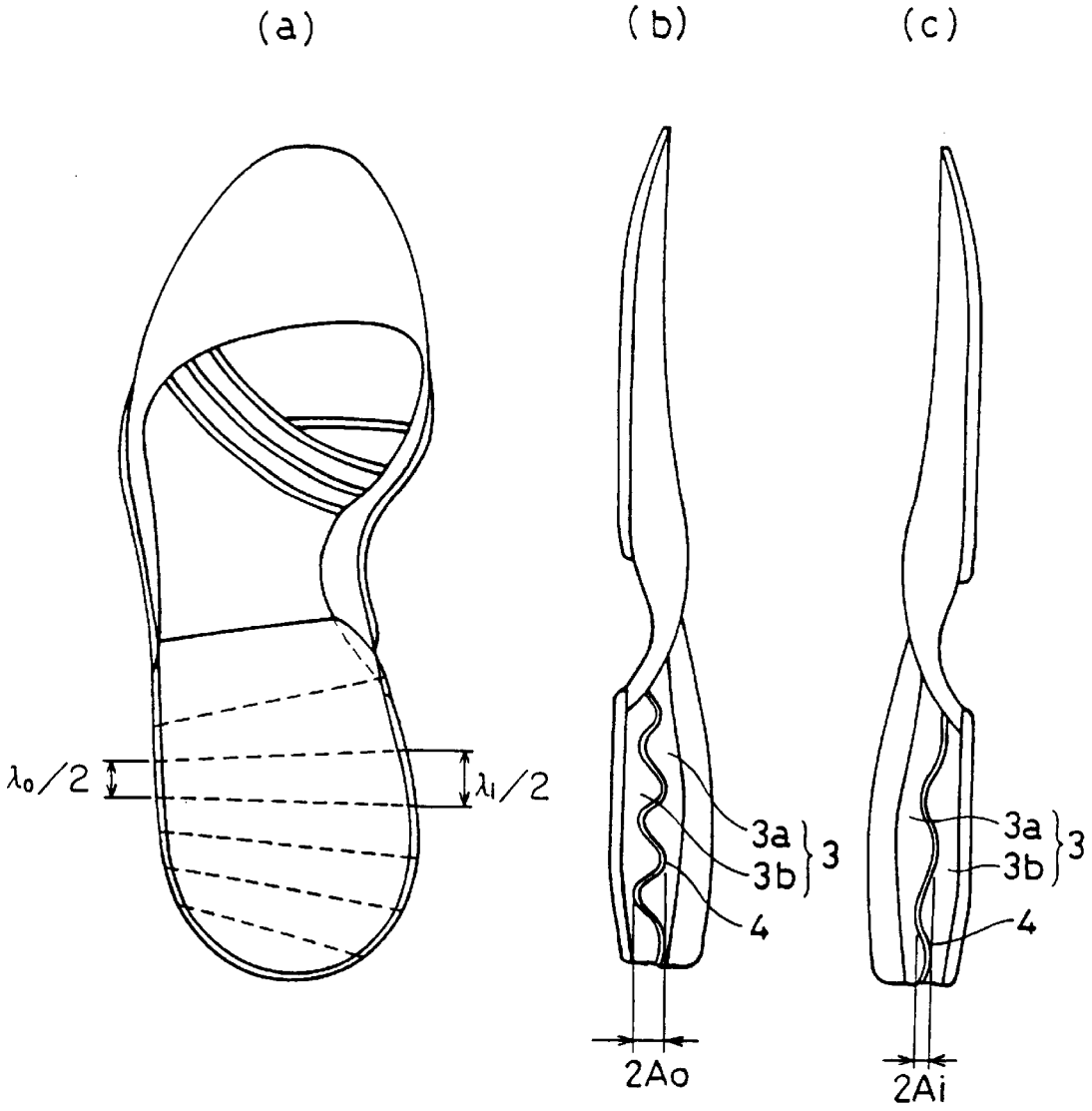

In the embodiment shown in FIG. 19, the following relation exists between the amplitudes Ai, Ao as in the embodiment in FIG. 17.

Ao>Ai

Moreover, the following relation also exists between the wavelengths λi and λo, different from the embodiment in FIG. 18.

λi/2>λo/2 or λi>λo

That is to say, in this embodiment, the wavelength of wave configuration of the corrugated sheet 4 is greater at the heel medial portion and smaller at the heel lateral portion. Therefore, in the athletics where athletes land more frequently at their heel lateral portions, when they land on the ground from the heel portions toward the toe portions of the shoes in sequence, the load path can nearly coincide with the direction perpendicular to each ridge line of wave configuration. As a result, the transverse deformation and the over-supination at the heel portion can be securely prevented and the larger contact area can be secured when landing. Thus, grip properties and wear resistant properties can be improved.

In another embodiment (not shown), the corrugated sheet 4 of each of the abovementioned embodiments has a higher hardness than that of the midsole 3. Generally, as shock load is repeatedly imparted to the midsole 3 when landing, the corrugated sheet 4 repeats deformation with the midsole 3. As a result, the midsole 3 gradually loses its elasticity and it becomes easy to be worn. On the contrary, when hardness of the corrugated sheet 4 is set higher, the midsole 3 becomes hard to be worn due to the restorative properties of the corrugated sheet 4. As a result, shock load in landing can be relieved during a prolonged use and cushioning can be secured.

In further embodiment (not shown), the corrugated sheet 4 of each of the abovementioned embodiments is formed of the fiber reinforced plastic (FRP). Thus, the corrugated sheet 4 will have improved elasticity and durability and be able to bear a prolonged use. The fiber reinforced plastic (FRP) is comprised of reinforcement fiber and matrix resin. Reinforcement fiber may be carbon fiber, aramid fiber, glass fiber and the like. Matrix resin may be thermoplastic or thermosetting resin.

In still further embodiment (not shown), each fiber of FRP In the above embodiment is oriented to the direction coinciding with the ridge direction of wave configuration of the corrugated sheet 4. Thus, elasticity in the ridge direction can be selectively improved without excessively increasing elasticity in the direction perpendicular to the ridge line.

Preferably. FRP fiber is aligned in one direction. In addition, FRP fiber is plain weave woven by a filling and warp. Preferably, the modulus of elasticity of the filling is greater than or equal to that of the warp and the filling is oriented to the direction coinciding with the ridge direction of wave configuration of the corrugated sheet 4.

Moreover, FRP fiber is aligned in one direction and the fiber is, preferably, oriented to the direction within ±30° with relation to the ridge direction of wave configuration of the corrugated sheet 4. In addition, preferably, the fiber is woven by the filling and warp, and the modulus of elasticity of the filling is greater than or equal to that of the warp, and the filling is oriented to the direction within ±30° with relation to the ridge direction of the wave configuration of the corrugated sheet 4.

Especially, when each ridge line direction is not respectively parallel as in the embodiments shown in FIGS. 15 and 16, the directions of aligned fibers and the filling should be oriented coinciding with the ridge line direction running through the general center line of the heel portion, and be oriented to the direction within ±30° with relation to the other ridge line directions.

Figure 20:
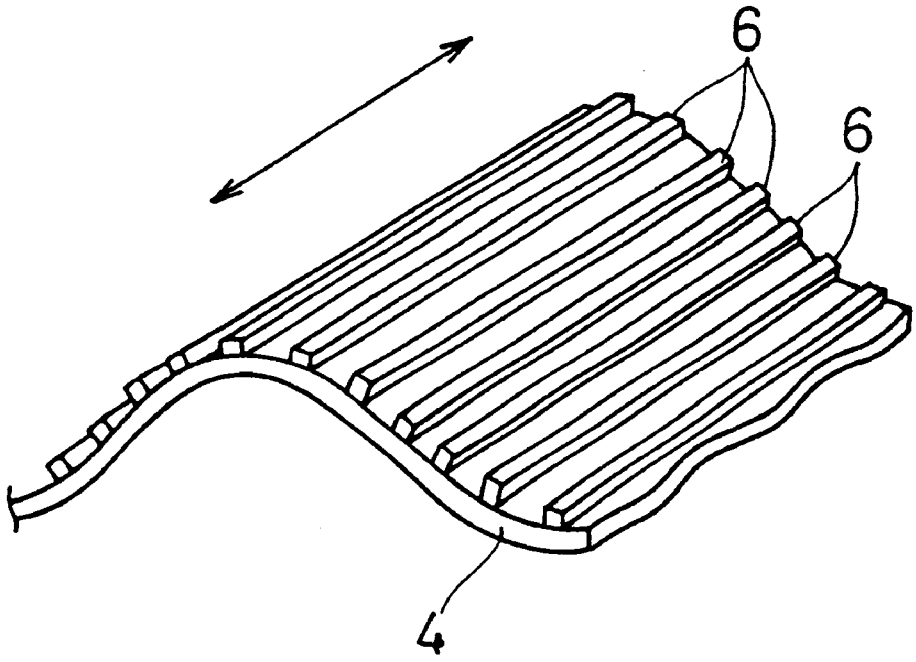
FIG. 20 is a perspective view of a portion of a corrugated sheet in the midsole construction of the another embodiment of the present invention.

In the embodiment shown in FIG. 20, there are provided a plurality of ribs 6 along the ridge lines on the surface of the corrugated sheet 4. By adopting such a rib construction in the corrugated sheet 4, elasticity in the ridge direction can be selectively improved without excessively increasing elasticity in the direction perpendicular to the ridge line direction.

Figure 21:
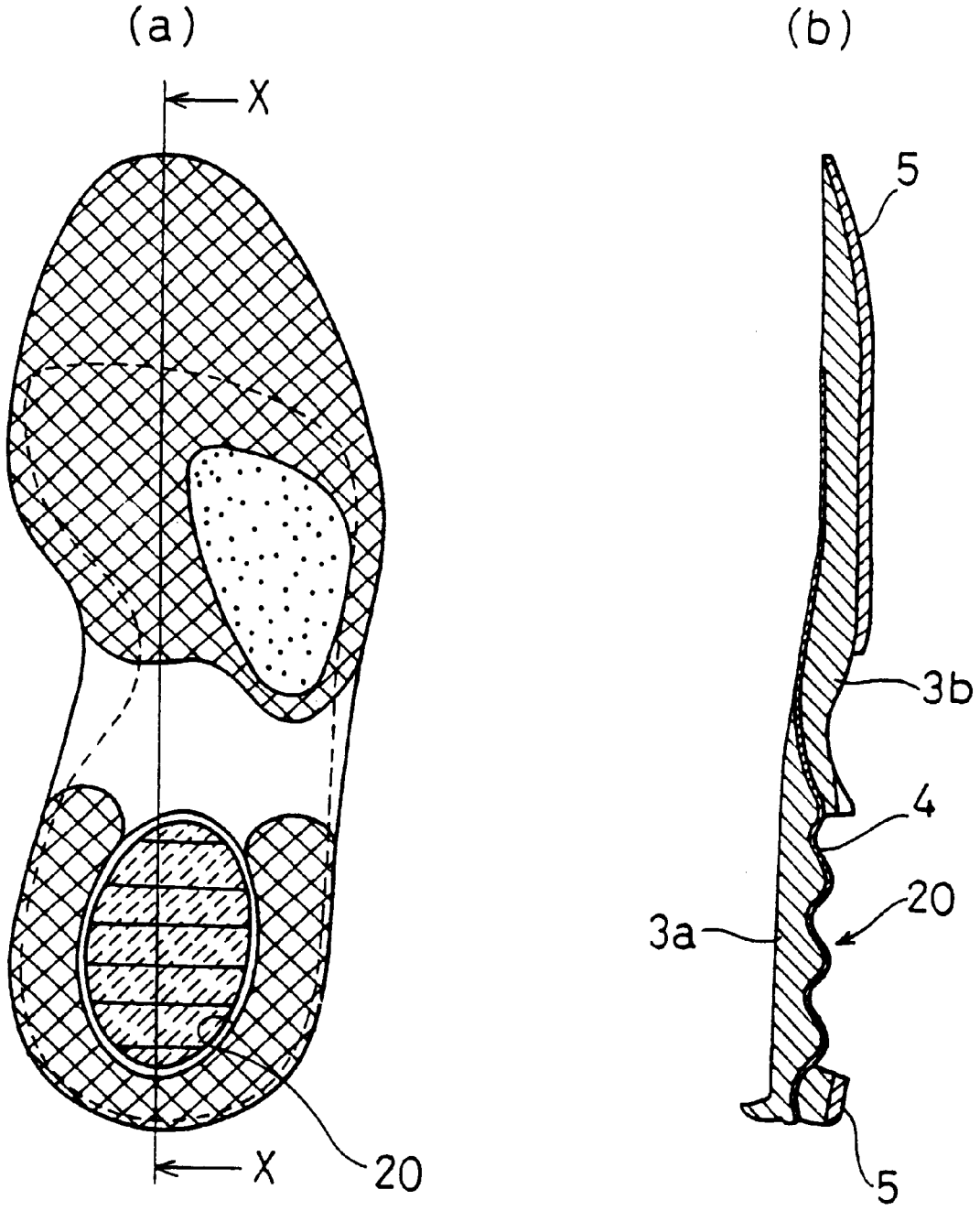
FIG. 21 is a schematic illustrating the midsole construction of the alternative embodiment of the present invention. In the Figure, (a) is a plantar view of the midsole construction of a left side shoe; (b) is a sectional view taken along the line X—X.

In the embodiment shown in FIG. 21, there is provided an aperture 20 penetrating the outsole 5 and lower midsole 3*b* in the center region of the heel portion of a shoe sole.

Figure 22:
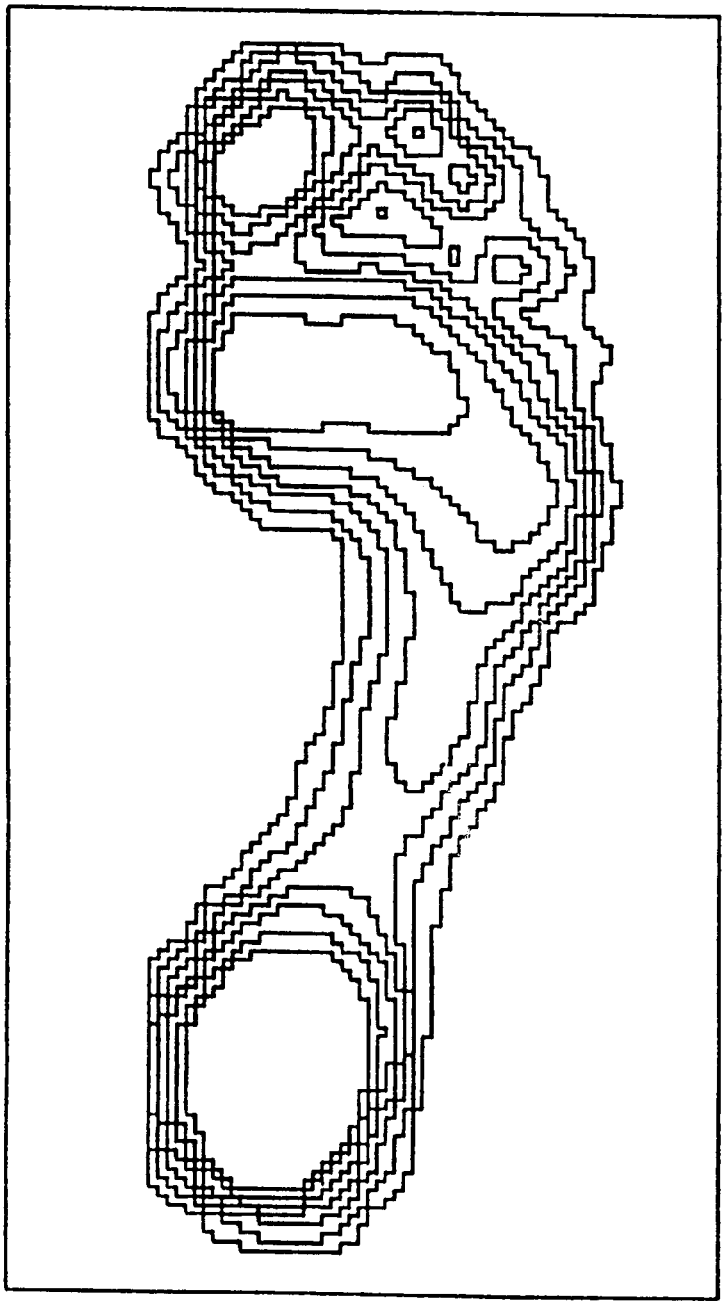
FIG. 22 is a schematic illustrating maximum pressures by the contour lines, forced against the sole of a human foot while his or her running.

In addition, FIG. 22 shows the maximum pressures by contour lines, forced upon the plantar of a foot during running or jogging. As seen from FIG. 22, the maximum forces are imparted to the central region of the heel portion. Therefore, adequate cushioning is required in the central region of the heel portion.

As shown in FIG. 21, when there is provided an aperture 20 in the center region of the heel portion, it will relatively decrease compressive hardness of the midsole construction in the center region by the compressive hardness taken by the lower midsole 3*b*.

As a result, adequate cushioning can be obtained in the center region. Moreover, in this embodiment, since the corrugated sheet 4 of a moderate elasticity supports the pressure received by the heel portion and disperses it in the lower midsole 3*b* and the outsole 5, the heel portion will not sink excessively.

Especially, It is very effective to provide an aperture in the heel portion of a shoe where its sole has a heel portion of an independent structure or of a slip preventive construction such as studs and the like because in this kind of sole landing pressure is easy to concentrate on the heel portion, compared to the flat sole.

In addition, some elderly people are attacked with pains caused by the fact that fats in the heel portions grow thin and the calcaneus spinae are pressed. The above aperture is also effective in easing these pains.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole formed of soft elastic material; and a corrugated sheet made of plastic material, said sheet being disposed in a heel region of said midsole, said corrugated sheet extending across the full width of said heel region, said heel region having a substantially constant thickness; and amplitude of wave configuration of said corrugated sheet being made different between a medial and a lateral portion of said heel region, said corrugated sheet thereby providing a higher compression hardness or lower cushioning properties in said medial portion of greater amplitude than said lateral portion of smaller amplitude of said heel portion.

2. The midsole assembly of claim 1, wherein said corrugated sheet is comprised of fiber-reinforced plastic.

3. The midsole assembly of claim 2, wherein fibers of said fiber-reinforced plastic are aligned in one direction.

4. The midsole assembly of claim 3, wherein fibers of said fiber-reinforced plastic are oriented to the direction coinciding with the direction of ridges of said wave configuration.

5. The midsole assembly of claim 3, wherein fibers of said fiber-reinforced plastic are oriented within ±30° with relation to the direction of ridges of said wave configuration.

6. The midsole assembly of claim 2, wherein fibers of said fiber-reinforced plastic are woven by filing and warp, the modulus of elasticity of said filling being larger than or equal to that of said warp.

7. The midsole assembly of claim 6, wherein said filling is oriented to the direction coinciding with the direction of ridges of said wave configuration.

8. The midsole assembly of claim 6, wherein said filling is oriented within ±30° with relation to the direction of ridges of said wave configuration.

9. A midsole assembly for an athletic shoe comprising:

a midsole formed of soft elastic material; and a corrugated sheet made of plastic material, said sheet being disposed in a heel region of said midsole, said corrugated sheet extending across the full width of said heel region, said heel region having a substantially constant thickness; and amplitude of wave configuration of said corrugated sheet being made different between a medial and a lateral portion of said heel region, said corrugated sheet thereby providing a higher compression hardness or lower cushioning properties in said lateral portion of greater amplitude than said medial portion of smaller amplitude of said heel portion.

* * * * *